US007852306B2

(12) United States Patent
Sun

(10) Patent No.: US 7,852,306 B2
(45) Date of Patent: Dec. 14, 2010

(54) LIQUID CRYSTAL DISPLAY DEVICE AND METHOD FOR DRIVING THE SAME

(75) Inventor: Won Young Sun, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1058 days.

(21) Appl. No.: 11/602,325

(22) Filed: Nov. 21, 2006

(65) Prior Publication Data

US 2007/0229436 A1 Oct. 4, 2007

(30) Foreign Application Priority Data

Mar. 30, 2006 (KR) ..... 10-2006-0028980
Aug. 28, 2006 (KR) ..... 10-2006-0081518

(51) Int. Cl.
*G09G 3/36* (2006.01)

(52) U.S. Cl. ..... 345/99; 345/87; 345/98

(58) Field of Classification Search ..... 345/87, 345/98, 99

See application file for complete search history.

(56) References Cited

U.S. PATENT DOCUMENTS

2005/0195671 A1* 9/2005 Taguchi ..... 365/203

FOREIGN PATENT DOCUMENTS

| | | |
|---|---|---|
| CN | 1779773 A | 5/2006 |
| JP | 52-022830 | 2/1977 |
| JP | 2001-228817 | 8/2001 |
| JP | 2002-251179 | 9/2002 |
| JP | 2003-099028 | 4/2003 |
| JP | 2004-004391 | 1/2004 |
| JP | 2005-192151 | 7/2005 |

* cited by examiner

*Primary Examiner*—My-Chau T Tran
(74) *Attorney, Agent, or Firm*—McKenna Long & Aldridge LLP

(57) ABSTRACT

A liquid crystal display device and a method for driving the same are disclosed. The method includes storing image data of one frame in a memory, selecting an output order of the data stored in the memory and outputting the data in the selected output order in accordance with a selection signal, sequentially latching the output data from the memory in a plurality of data ICs to drive a plurality of data lines; and sequentially driving a plurality of gate ICs to drive a plurality of gate lines.

16 Claims, 5 Drawing Sheets

LIQUID CRYSTAL DISPLAY DEVICE AND METHOD FOR DRIVING THE SAME

This application claims the benefit of Korean Patent Applications No. 10-2006-28980, filed on Mar. 30, 2006 and No. 10-2006-81518, filed on Aug. 28, 2006, which is hereby incorporated by reference for all purposes as if fully set forth herein.

BACKGROUND OF THE INVENTION

1. Field of the Invention

The present invention relates to a liquid crystal display (LCD) device and more particularly, to an LCD device and a method for driving the same for generating a reversible image display.

2. Discussion of the Related Art

Recently, various flat panel displays having smaller size and weight than typical cathode ray tube based displays have been developed. Examples of flat panel displays include liquid crystal displays (LCD), field emission displays (FED), plasma display panels (PDP), and light emitting diode (LED) displays.

Among flat panel displays, the LCD is actively used for notebook computers, desktop computers, and mobile terminals because of its characteristic excellent resolution, display of colors, and picture quality.

The LCD displays a picture image by controlling light transmittance of liquid crystal cells using an electric field. The LCD includes an LCD panel having liquid crystal cells, a back light unit for irradiating light onto the LCD panel, and a driving circuit for driving the liquid crystal cells.

The driving circuit includes an integrated circuit (IC) for driving the liquid crystal cells. The LCD is classified as a tape carrier package type, a chip on film type, or a chip on glass (COG) type according to the technology used to connect the IC to the LCD panel.

FIG. 1 illustrates a related art COG type LCD device.

Referring to FIG. 1, the related art COG type LCD device includes an LCD panel 10 provided with pixel cells P formed in pixel regions defined by the crossings of a plurality of gate and data lines GL and DL; data ICs 20 directly mounted on a first side of the LCD panel 10 to supply data signals to the data lines DL; a first flexible printed circuit (FPC) 30 to supply the data signals to the respective data ICs 20; gate ICs 40 directly mounted on a second side of the LCD panel to supply gate pulse signals to the gate lines GL; and a second FPC 50 to supply gate driving signals to the respective gate ICs 40.

The first and second FPCs used to drive the data and gate ICs of the related art COG type LCD device are expensive, and the expense increases the overall cost of the LCD device.

A related art LCD device having a single FPC has been developed to provide a reduced cost solution. The single FPC is connected to a first data IC and second gate IC to reduce the manufacturing cost. A related art LCD device employing a single FPC will be described in detail with reference to FIGS. 2A and 2B.

Referring to FIGS. 2A and 2B, a related art LCD device having a single FPC includes an LCD panel 110 having pixel cells P formed in pixel regions defined by the crossings of plurality of gate and data lines GL and DL; a control board 150 to drive data ICs 120*a* to 120*d* and gate ICs 140*a* and 140*b*; an FPC 130 connected between the LCD panel 110 and the control board 150; the plurality of data ICs 120*a* to 120*d* directly mounted on a first side of the LCD panel 110 and cascaded to supply data signals to the data lines DL; and the plurality of gate ICs 140*a* and 140*b* directly mounted on a second side of the LCD panel 110 and cascaded to supply gate pulse signals to the gate lines GL.

The LCD panel 110 includes lower and upper substrates 102 and 104 facing each other and bonded to each other. The FPC 130 is connected to first and second regions of the lower substrate 102, where the first region is formed in the first side of the lower substrate 102 of the LCD panel 110 and the second region is formed on the second side of the lower substrate 102 of the LCD panel 110. The FPC 130 is also connected to the control board 150 through a connector.

The first region includes data COG regions on which the data ICs 120*a* to 120*d* are mounted; a plurality of line on glass lines (LOGs) 124 as data lines cascading the data ICs 120*a* to 120*d* to the FPC 130; and a plurality of data pads connecting the data ICs 120*a* to 120*d* with the data lines DL.

The second region includes gate COG regions on which the gate ICs 140*a* and 140*b* are mounted and a plurality of gate LOGs 144 cascading the gate ICs 140*a* and 140*b* in cascade to the FPC 130.

The control board 150 includes a timing controller 152 to control the data ICs 120*a* to 120*d* and the gate ICs 140*a* and 140*b*; a power generator 154 to generate driving power; and a connector to connect the control board to the FPC 130.

The data ICs 120*a* to 120*d* are mounted in the data COG regions and are connected in series with the FPC 130 via the data LOGs 124. In addition, the data ICs 120*a* to 120*d* sequentially latch cascaded digital data and convert the latched digital data to analog data signals to be supplied to the data lines DL.

The first data IC 120*a* is supplied with data driving signals, including, data signals, data control signals, and data driving power from the control board 150 through the first data LOGs 124 connected to the FPC 130. The second data IC 120*b* is supplied with the data driving signals, including, data signals, data control signals, and data driving power from the control board 150 through the FPC 130, the first data LOGs 124, the first data IC 120*a* and the second data LOGs 124.

The gate ICs 140*a* and 140*b* are supplied with the gate driving signals, including, gate control signals and gate driving power from the control board 150 through the gate LOGs 144 connected to the FPC 130. The gate ICs 140*a* and 140*b* supply gate pulses that sequentially drive the gate lines GL in response to the gate control signals.

As described above, the related art LCD device is provided with a single FPC connected in cascade to the data ICs 120*a* to 120*d* and also connected in cascade to the gate ICs 140*a* and 140*b*. In such a related art LCD device, picture quality can vary in all directions depending on the main viewing angles.

For example, in the LCD device for use in a notebook computer, the main viewing angle is in a direction from a point above the upper portion of the screen at a predetermined angle around a direction perpendicular to the screen. On the other hand, in the LCD device for use in public places or public transportation means such as buses, trains and airplanes, the main viewing angle is in a direction from a point below the display at a predetermined angle around a direction perpendicular to the screen. Further, in the LCD device for use in an audio system installed between a driver's seat and a seat next to the driver or in the LCD device for use in display of various kinds of information, the main viewing angle is in a direction from either the left or a right side of the display at a predetermined angle around a direction perpendicular to the screen.

Accordingly, the related art LCD device is manufactured to have a reversible function in all directions depending on its use condition.

A method for driving the related art, single FPC LCD device to display a reversible screen in an image display of the LCD panel 110 will be described with reference to FIG. 2A.

To drive the screen in reverse, the first data control signal, i.e., a first start pulse SSP1 is input to the fourth data IC 120*d* (the last data IC) through a first data control signal line 126*a* connected to the last data IC 120*d*, the data signals input to the data LOGs 124 are latched in the fourth data IC 120*d* in reverse order starting from the first data signal. Here, the first data control signal line 126*a* is connected between FPC 130 and the fourth data IC 120*d* through the data LOGs 124 and the first to the third data IC 120*a* to 120*c*.

Subsequently, once the data signals corresponding to the fourth data IC 120*d* are all latched the fourth data IC 120*d* generates a carry signal. The carry signal is then input to the third data IC 120*c* through a carry signal line 125. Subsequently, the third data IC 120*c* is enabled by the carry signal to latch the data signals input to the data LOGs 124 in reverse order starting from the next data signals of the data signals latched in the fourth data IC 120*d*.

In this way, the data corresponding to one horizontal line are all latched in reverse order from the fourth data IC 120*d* to the first data IC 120*a*. The latched data are simultaneously converted into analog data signals, and the converted analog data signals are output to the data lines DL. The reverse order latching operation described above is repeated for each horizontal line, and the latched data is repeatedly converted into analog data signals to be output to the data lines DL.

Further, to drive the LCD panel in reverse, a first gate start pulse GSP1 is input the second gate IC 140*b* (the last gate IC) through a first gate control signal line 127*a*. The first gate control signal line 127*a* is connected between FPC 130 and the second gate IC 140*b* through the gate LOGs 144 and the first gate IC 140*a*. The second gate IC 140*b* and the first gate IC 140*a* are driven in reverse order in response to the first gate start pulse GSP1. Thus, the gate lines are driven in reverse order from the last gate line to the first gate line.

As described above, the data ICs 120*a* to 120*d* latch the data in reverse order and supply the latched data to the data lines DL, and the gate ICs 140*a* and 140*b* drive the gate lines in reverse order, so that the LCD panel 110 displays the reversed screen.

A method for driving the related art, single FPC LCD device to display a normal screen as opposed to a reversed screen on the LCD panel 110 will be described with reference to FIG. 2B.

First, when the second data control signal, i.e., a second start pulse SSP2 is input to the first data IC 120*a* through a second data control signal line 126*b*, the data signals input to the data LOGs 124 are latched in the first data IC 120*a* to the fourth data IC 120*d* in forward order starting from the first data signal.

In this way, the data corresponding to one horizontal line are all latched in the first to fourth data ICs 120*a* to 120*d* in forward order. The latched data are simultaneously converted into analog data signals, and the converted analog data signals are output to the data lines DL. The forward latching operation of the first to fourth data ICs 120*a* to 120*d* described above is repeated for horizontal line. The latched data is repeatedly converted into analog data signals and the converted signals are output to the data lines DL for each horizontal line.

The gate ICs 140*a* and 140*b* are sequentially driven from the first gate line to the last gate line in response to the second gate start pulse GSP2 supplied to the first gate IC 140*a* through the second gate control signal line 127*b*.

As described above, the data ICS 120*a* to 120*d* latch the data in forward order and supply the latched data to the data lines DL, and the gate ICs 140*a* and 140*b* drive the gate lines in forward order, whereby the LCD panel 110 displays the normal screen.

However, the first data control signal line 126*a* through which the data driving signals are input to display the reversed screen as shown in FIG. 2A is longer than the second data control signal line 126*b* to which the data control signals are input to display the normal screen as shown in FIG. 2B. The increased length of the first data control signal line 126*a* results in increased line resistance causing signal delay resulting in a defective image display.

SUMMARY OF THE INVENTION

Accordingly, the present invention is directed to a liquid crystal display (LCD) device and a method for driving the same that substantially obviates one or more of the problems due to limitations and disadvantages of the related art.

An advantage of the present invention is to provide an LCD device and a method for driving the same, in which a normal screen and a reversed screen are displayed in an image display without signal delay.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, an LCD device includes an LCD panel provided with pixel regions defined by a plurality of gate lines crossing a plurality of data lines; a data driver to supply data signals to the data lines; a gate driver to supply gate signals to the gate lines; and a timing controller including a memory to store one field of image data, the timing controller to control the data driver and the gate driver and to select an order of output of image stored data in the memory to supply the data driver to select between generation of a normal screen and a reversed screen in the LCD panel.

In another aspect of the present invention, a method for driving an LCD device includes storing image data of one frame in a memory; outputting the data stored in the memory in an order opposite to an order in which the data was previously input if a selection signal indicates a reversed screen; sequentially latching the output data in a plurality of data ICs to drive a plurality of data lines; and sequentially driving a plurality of gate ICs to drive a plurality of gate lines.

In another aspect of the present invention, a method for driving an LCD device includes storing image data of one frame in a memory; selecting an output order of the data stored in the memory and outputting the data in the selected output order in accordance with a selection signal; sequentially latching the output data from the memory in a plurality of data ICs to drive a plurality of data lines; and sequentially driving a plurality of gate ICs to drive a plurality of gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
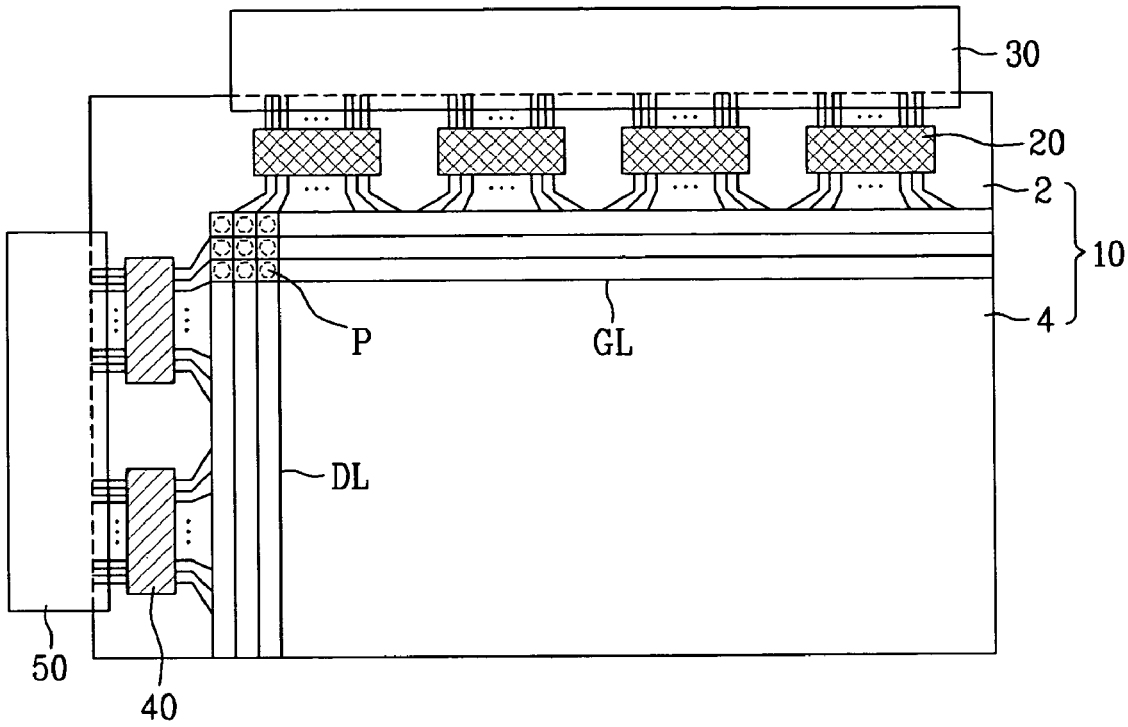
FIG. 1 Related Art
FIG. 1 illustrates a related art chip on glass (COG) type liquid crystal display (LCD) device.
Figure 2A:
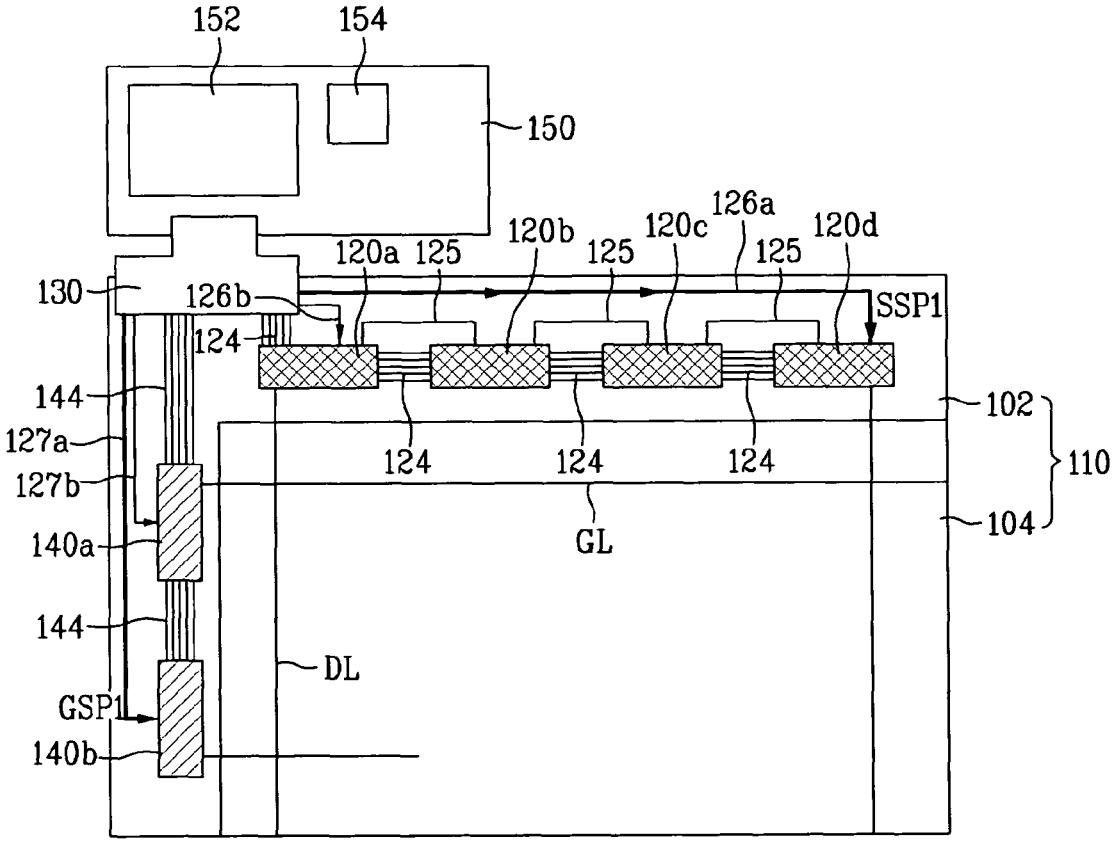
FIG. 2A Related Art
FIGS. 2A and 2B illustrates a related art LCD device provided with a single flexible printed circuit (FPC)
Figure 2B:
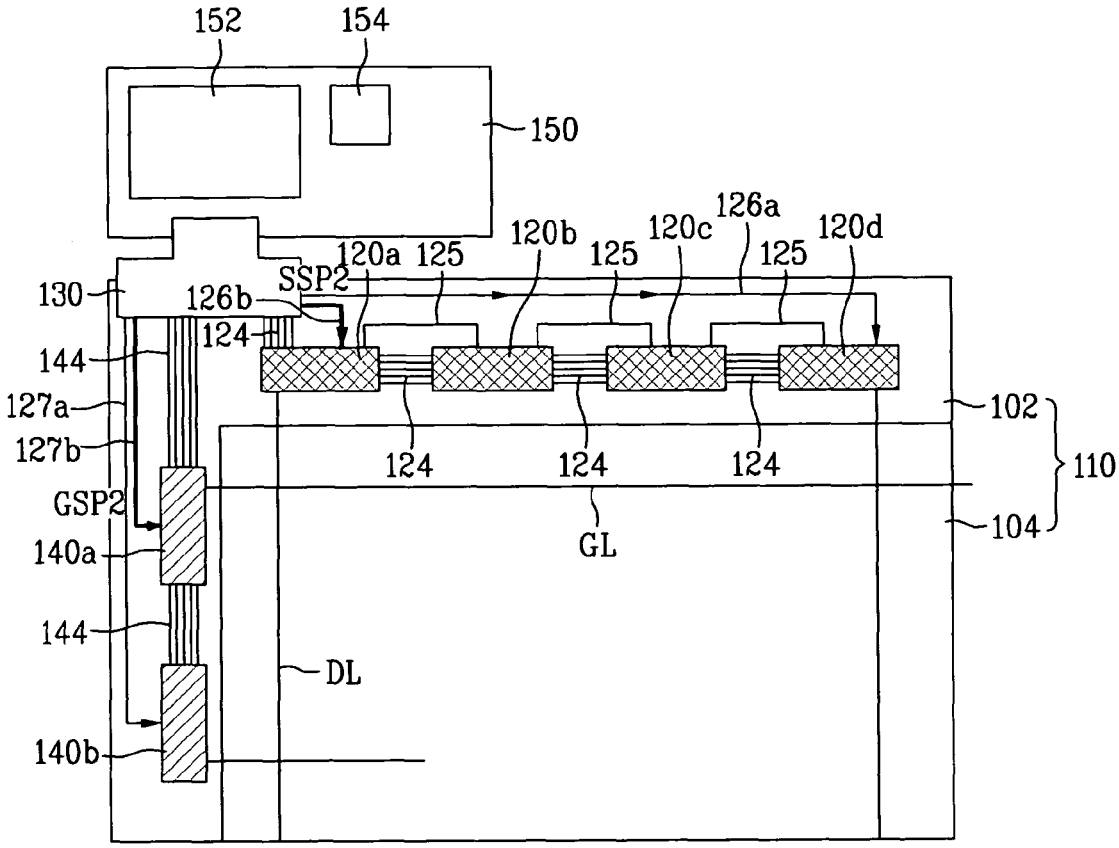
FIG. 2B Related Art
Figure 3:
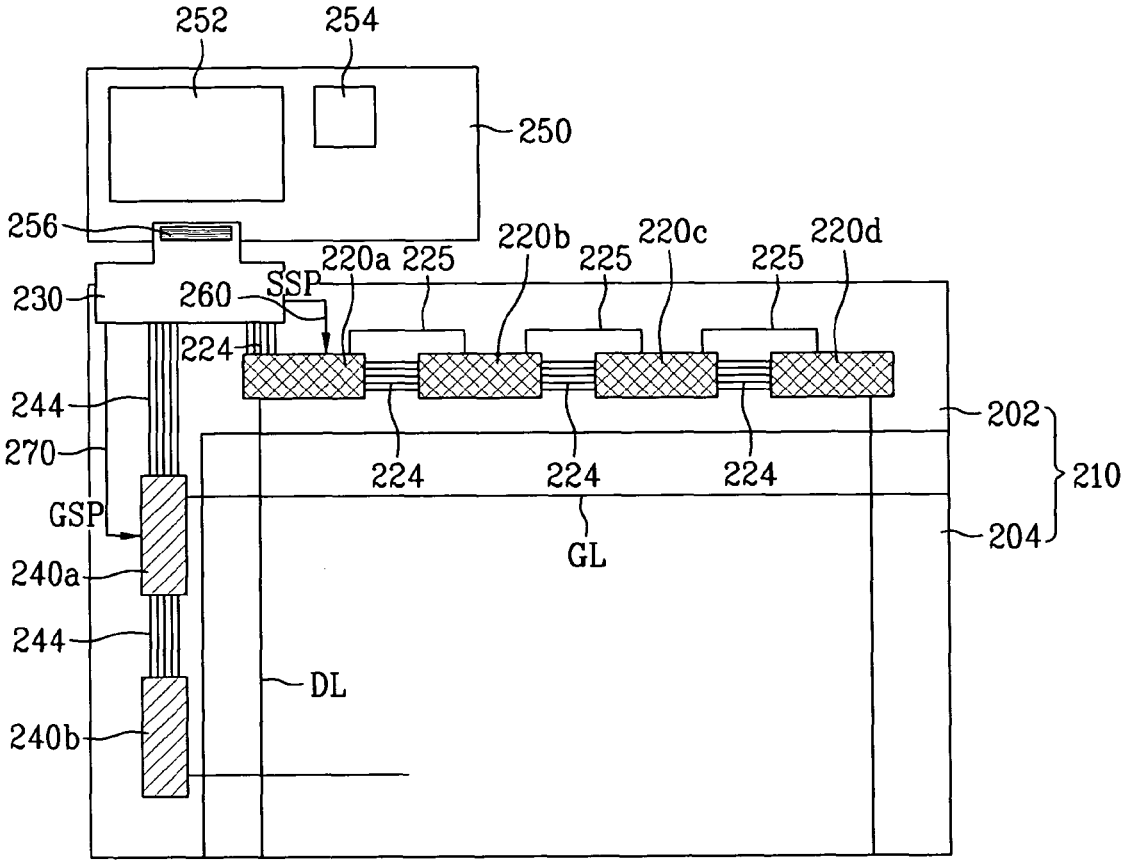
FIG. 3 illustrates an LCD device provided with a single FPC according to an embodiment of the present invention.

FIG. 3 illustrates a liquid crystal display (LCD) device provided with a single flexible printed circuit (FPC) according to the present invention.

As shown in FIG. 3, an LCD device according to an embodiment of the present invention is provided with a single FPC and cascading data integrated circuits (ICs). The LCD device includes an LCD panel 210 provided with pixel cells P in each region defined by a the crossings of a plurality of gate and data lines GL and DL; a plurality of data ICs 220*a* to 220*d* directly mounted on a first side of the LCD panel 210 and sequentially cascaded to supply data signals to the data lines DL; a plurality of gate ICs 240*a* and 240*b* directly mounted on a second side of the LCD panel 210 and sequentially cascaded to supply gate pulse signals to the gate lines GL; a control board 250 to generate data and gate driving signals to respectively drive the plurality of data ICs 220*a* to 220*d* and the plurality of gate ICs 240*a* and 240*b*; an FPC 230 connected between the LCD panel 210 and the control board 250; a data control signal line 260 connected between the FPC 230 and the first data IC 220*a*; and a gate control signal line 270 connected between the FPC 230 and the first gate IC 240*a*.

The LCD panel 210 includes lower and upper substrates 202 and 204 facing each other and bonded to each other. A liquid crystal layer is formed between the lower and upper substrates 202 and 204, and a spacer is formed to maintain a uniform gap between the lower and upper substrates 202 and 204.

The upper substrate 204 includes a color filter, a common electrode, and a black matrix. The common electrode may alternatively be formed on the lower substrate 202.

The lower substrate 202 includes the plurality of data lines DL; the plurality gate lines GL crossing the data lines DL; thin film transistors formed at pixel regions defined by crossings of the gate and data lines; and pixel cells connected to the thin film transistors. The thin film transistors supply the data driving signals from the data lines DL to the pixel cells in response to the gate pulse signals from the gate lines GL. Each of the pixel cells includes common and pixel electrodes facing each other with the liquid crystal layer interposed therebetween. Therefore, the pixel cell may be represented as a liquid crystal capacitor. The pixel cell includes a storage capacitor that maintains the data signal applied to the liquid crystal capacitor until a next data signal is applied to the liquid crystal capacitor.

A first region on the first side of the lower substrate 202 includes a data pad portion, and a second region on the second side of the lower substrate 202 includes a gate pad portion. The data pad portion is connected to the respective data lines DL while the gate pad portion is connected to the respective gate lines GL.

The first region further includes data chip on glass (COG) regions on which the data ICs 220*a* to 220*d* are mounted; a plurality of data line on glass lines (LOGs) 224 cascading the data ICs 220*a* to 220*d* to the FPC 230; the data control signal line 260 connected between the FPC 230 and the first data IC 220*a* to supply a source start pulse SSP to the first data IC 220*a*; and a plurality of data pads connecting the data ICs 220*a* to 220*d* with the data lines DL. The data LOGs 224 are respectively formed between the FPC 230 and the first data IC 220*a* and between the respective second to fourth data ICs 220*b* to 220*d*. The data LOGs 224 include a plurality of data transmission lines transmitting digital data; a plurality of control signal transmission lines transmitting data control signals other than the source start pulse SSP; and a plurality of power lines transmitting data driving power.

The second region includes gate COG regions on which the gate ICs 240*a* and 240*b* are mounted; a plurality of gate LOGs 244 cascading the gate ICs 240*a* and 240*b* to the FPC 230; the gate control signal line 270 connected between the FPC 230 and the first gate IC 240*a* to supply a gate start pulse GSP; and a plurality of gate pads connecting the gate ICs 240*a* to 240*d* with the gate lines GL. The gate LOGs 244 are respectively formed between the FPC 230 and the first gate IC 240*a* and between the first and second gate ICs 240*a* and 240*b*. The gate LOGs 244 include a plurality of control signal transmission lines transmitting gate control signals other than the gate start pulse GSP and a plurality of power lines transmitting gate driving power.

The FPC 230 includes a connector extended from one side of the FPC 230 to connect with a connector 256 of the control board 250 and a plurality of output pads connected to the data LOGs 224 and the gate LOGs 244. The FPC 230 supplies the digital data, the data control signals and the data driving power from the control board 250 to the data LOGs 224 and the data control signal line 260, and supplies the gate control signals and the gate driving power to the gate LOGs 244 and the gate control signal line 270.

The control board 250 includes a timing controller 252 to drive the data ICs 220*a* to 220*d* and the gate ICs 240*a* and 240*b*, a power generator 254 to generate the driving power, and the connector 256 connected to the FPC 230.

Figure 4:
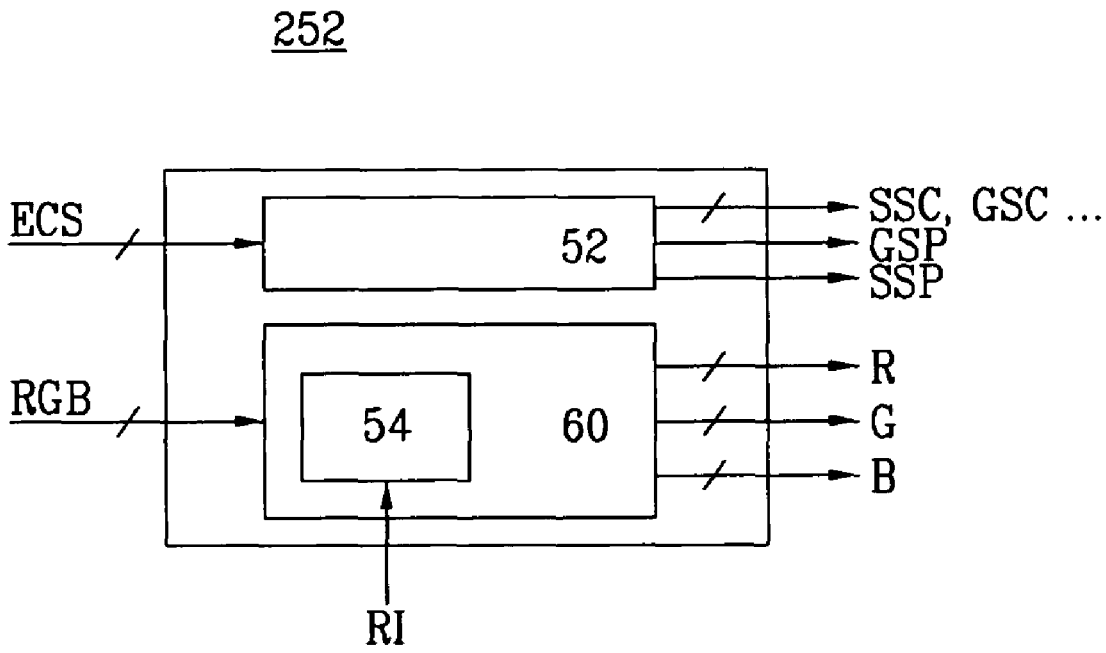
FIG. 4 is a block diagram illustrating a timing controller according to an embodiment of the present invention.

The timing controller 252, as shown in FIG. 4, includes a data processor 60 to align externally input data RGB to be suitable to drive the LCD panel 210 to generate data signals R, G, and B, and a control signal generator 52 to generate the data control signals and the gate control signals using external control signals ECS, wherein the data control signals serve to control the data ICs 220*a* to 220*d*, and the gate control signals serve to control the gate ICs 240*a* and 240*b*. The data control signals include the source start pulse SSP, a source shift clock SSC, a source output enable SOE signal, and a polarity control signal POL. The gate control signals include the gate start pulse GSP, a gate shift clock GSC, and a gate output enable GOE signal.

The timing controller 252 further includes a memory 54 to store the data signals of one frame aligned by the data processor 60 and to reverse or maintain the output order of the data signals to display a reversed screen or a normal screen in response to a reverse selection signal RI of the image display of the LCD panel 210. In other words, the data signals output from the data processor 60 are stored in the memory 54. The memory 54 outputs the data signals in the same order as the input order or outputs the data signals in an order opposite to the order they are input in response to the reverse selection signal RI.

The power generator 254 generates the driving power required to drive the LCD panel 210, the data ICs 220*a* to 220*d*, and the gate ICs 240*a* and 240*b*.

The data ICs 220*a* to 220*d* are mounted in the first data COG region, and are connected with one another through the data LOGs 224. Each of the data ICs 220*a* to 220*d* converts the digital data into analog data signals in response to the data control signals and supplies the converted signals to the data lines DL. In the illustrated embodiment of the present invention, the LCD device includes four data ICs 220*a* to 220*d*. However the invention may be practiced with a different number of data ICs.

The first data IC 220*a* is supplied with the data driving signals, including the data signals, the data control signals, and the data driving power from the control board 250 through the data LOGs 224 connected with the FPC 230. The first data IC 220*a* is also supplied with the source start pulse SSP among the data control signals through the data control line 260 connected with the FPC 230.

The second data IC 220*b* is supplied with the data signals, the data control signals, and the data driving power from the control board 250 through the preceding first data IC 220*a* and the data LOGs 224 connected between the first and second data ICs 220*a* and 220*b*. Likewise, the third and fourth data ICs 220*c* and 220*d* are supplied with the data signals, the data control signals and the data driving power through the data LOGs 224 connected to their respective preceding data ICs.

The gate ICs 240*a* and 240*b* are mounted in the second COG region, and are supplied with the gate driving signals, i.e., the gate control signals and the gate driving power from the control board 250 through the FPC 230 and the gate LOGs 244. The gate ICs 240*a* and 240*b* sequentially generate gate pulses in response to the gate control signals and supplies the generated gate pulses to the gate lines GL. In embodiment illustrated in FIG. 3, it is to be understood that the LCD device includes two gate ICs 240*a* and 240*b*. However practice of the invention is not limited to LCD devices with two gate ICs.

The first gate IC 240*a* is supplied with the gate control signals and the gate driving power from the control board 250 through the gate LOGs 244 connected with the FPC 230. The first gate IC 240*a* is also supplied with the gate start pulse GSP from the control board 250 through the gate control signal line 270 connected with the FPC 230. The second gate IC 240*b* is supplied with the gate control signals and the gate driving power through the gate LOGs 244 connected to the first gate IC 220*a*.

To display the reversed screen in the LCD device according to an embodiment of the present invention, the source start pulse SSP is input to the first data IC 220*a*, and the gate start pulse GSP is input to the first gate IC 240*a*. The timing controller 253 outputs the data of one frame stored in the memory 54 in opposite order from the input order in response to the reversible selection signal RI, so that the data are input to the data ICs 220*a* to 220*d* in forward order per horizontal line.

The operation of the LCD device to generate normal and reversed displays is described in more detail hereinafter.

To display the normal screen in the image display of the LCD device, the externally input source data RGB are aligned by the data processor 52, and the aligned data are stored in the memory 54.

When the reversible selection signal RI is not input to the memory 54, the memory 54 outputs the data stored therein in the input order, i.e., in order from the first data signal to the fourth data signal to display the normal screen.

When the source start pulse SSP is input to the first data IC 220*a* through the data control line 260, the first data IC 220*a* latches the first data signals input through the data LOGs 224 in forward order.

Subsequently, after the first data signals corresponding to the first data IC 220*a* are all latched, the first data IC 220*a* generates a carry signal. The carry signal generated by the first data IC 220*a* is input to the second data IC 220*b* through a carry signal line 225. The second data IC 220*b* is enabled by the carry signal so that the second data signals supplied following the first data signals through the data LOGs 224 are latched in forward order. The third and fourth data ICs 220*c* and 220*d* also latch the third and fourth signals supplied through the data LOGs 224 in response to the carry signal generated in forward order.

Once the data corresponding to a horizontal line are all latched in the first to fourth data ICs 220*a* to 220*d* in forward order, the latched data are simultaneously converted into analog data signals and the converted signals are output to the data lines DL. The first to fourth data ICs 220*a* to 220*d* repeat the above operation for each horizontal line of the display, i.e., the first to fourth data ICs 220*a* to 220*d* repeatedly latch the data for each horizontal line in forward order as described above and repeatedly convert the latched data into the analog data signals to output the converted signals to the data lines DL.

The gate ICs 240*a* and 240*b* are sequentially driven starting from the first gate line through to the last gate line in response to the gate start pulse GSP supplied to the first gate IC 240*a* through the gate control signal line 270.

As described above, the memory 54 of the timing controller 252 outputs the data in a first-in first-out (FIFO) manner, the data ICs 220*a* to 220*d* latch the output data in forward order and supply the latched data to the data lines DL, and the gate ICs 240*a* and 240*b* drive the gate lines GL in forward order, whereby the LCD panel 110 displays the normal screen.

To display the reversed screen in the image display of the LCD device, the externally input source data RGB are aligned by the data processor 52, and the aligned data are stored in the memory 54.

When the reversible selection signal RI is input to the memory 54, the memory 54 outputs the data stored therein in the contrary order of the input order to display the reversed screen. For example, the memory 54 may store the data of one frame as shown in Table 1.

TABLE 1

| | | | | | |
|---|---|---|---|---|---|
| R10 | R11 | R12 | . . . | R1(m − 1) | R1m |
| G10 | G11 | G12 | . . . | G1(m − 1) | G1m |
| B10 | B11 | B12 | . . . | B1(m − 1) | B1m |
| . | . | . | . | . | . |
| . | . | . | . | . | . |
| . | . | . | . | . | . |
| Rn0 | Rn1 | Rn2 | . . . | Rn(m − 1) | Rnm |
| Gn0 | Gn1 | Gn2 | . . . | Gn(m − 1) | Gnm |
| Bn0 | Bn1 | Bn2 | . . . | Bn(m − 1) | Bnm |

Referring to Table 1, the data are input to the memory 54 in due order starting from the data R10, G10 and B10 corresponding to a [1,1]th pixel of the LCD panel 210 to the data Rnm, Gnm and Bnm corresponding to a [n,m]th pixel. For example, the data R11, G11 and B11 are input to the memory 54 after the data R10, G10 and B10 are input to the memory 54 and are also read out after the data R10, G10 and B10 are read out to generate the normal display. If the reversible selection signal RI is input to the memory 54, the stored data are read out of the memory in reverse order starting from the data Rnm, Gnm and Bnm corresponding to the [n,m]th pixel to the data R10, G10 and B10 corresponding to the [1,1]pixel. For example, when generating the reversed display, the data Rn(m−1), Gn(m−1) and Bn(m−1) are output after the data Rnm, Gnm and Bnm because the order of the output is to be contrary or opposite to the order in which the data was input.

In other words, to generate a reversed display, the memory 54 outputs the data in the order from the last nth horizontal line to the first horizontal line, and in order from the last mth pixel of each horizontal line to the first pixel.

The data after being output in reverse order from the memory 54 are latched in the first to fourth data ICs 220*a* to 220*d* in forward order for each horizontal line in response to the source start pulse SSP supplied to the first data IC 220*a*. The first to fourth data ICs 220*a* to 220*d* convert the latched data into the analog data and outputs the analog data to the data lines DL. In other words, the data is output from the memory 54 in reverse order starting from the data of the nth horizontal line and latched in the first to fourth data ICs 220*a* to 220*d* in forward order per horizontal line. The latched data are supplied to the data lines DL.

The first and second gate ICs 240*a* and 240*b* are driven in forward order in response to the gate start pulse GSP supplied to the first gate IC 240*a*, so that the gate lines GL are sequentially driven.

Therefore, the data corresponding to the nth horizontal line supplied to the first to fourth data ICs 220*a* to 220*d* in reverse order and latched in forward order are filled in the first horizontal line of the LCD panel 210 when the first gate line GL is driven. The data corresponding to the first horizontal line supplied to the first to fourth data ICs 220*a*, to 220*d* in reverse order and latched in forward order are filled in the nth horizontal line of the LCD panel 210 when the nth gate line GL is driven. As a result, the reversed screen is displayed in the LCD panel 210.

As described above, the memory 54 of the timing controller 252 outputs the data in the contrary order of the input order, the data ICs 220*a* to 220*d* latch the output data in forward order and supply the latched data to the data lines DL, and the gate ICs 240*a* and 240*b* drive the gate lines GL in forward order, whereby the LCD panel 110 displays the reversed screen. In other words, since the LCD device according to the present invention converts the output order of the data through the memory to display the reversed screen, the data ICs 220*a* to 220*d* and the gate ICs 240*a* and 240*b* need not be driven in reverse order. Accordingly, the normal screen and the reversed screen can be displayed in the LCD panel 210 using only one source start pulse SSP and one gate start pulse GSP.

As described above, the LCD device and the method for driving the same according to the present invention have the following advantages.

Since the output order of the data signals for displaying the reversed screen or the normal screen is converted in response to the reversible selection signal from the timing controller, the data ICs and the gate ICs may be driven in the forward order and arrangements to drive the gate ICs and the data ICs in the reverse order may be omitted. As a result, the LCD panel may be provided with only one source start pulse to be supplied to the first data IC and one gate start pulse to be supplied to the first gate IC for generating either a reversed or a normal screen. Consequently, it is possible to avoid a screen defect caused by signal delay of the start pulses supplied to the last data and gate ICs.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) device comprising:

an LCD panel provided with pixel regions defined by a plurality of gate lines crossing a plurality of data lines;

a data driver to supply data signals to the data lines;

a gate driver to supply gate signals to the gate lines; and a timing controller controlling the data driver and the gate driver, wherein the timing controller includes a memory which selects an order of output of image data stored in the memory to supply the data driver to select between generation of a normal screen and a reversed screen in the LCD panel, wherein the memory outputs the stored image data in the same order as an input order or outputs the stored image data in an order opposite to the input order wherein the output order for the reversed screen is opposite to the output order for the normal screen.

2. The LCD device as claimed in claim 1, wherein the data driver includes a sequence of cascaded data ICs arranged on a first side of the LCD panel, a first data IC of the sequence of cascaded data ICs to receive data output from the memory.

3. The LCD device as claimed in claim 1, wherein the gate driver includes a sequence of cascaded gate ICs arranged on a second side of the LCD panel to supply gate driving signals a first gate IC of the sequence of cascade gate ICs.

4. The LCD device as claimed in claim 1, wherein the timing controller is to select an output order for image data stored in the memory in response to a selection signal.

5. The LCD device as claimed in claim 4, wherein the timing controller is to select an output order for image data stored in the memory to be the same as an input order of the data if the selection signal indicates the normal screen, and is to select the output order for image data stored in the memory to be the opposite of the input order of the image data stored in memory if the selection signal indicates the reversed screen.

6. The LCD device as claimed in claim 4, wherein the timing controller is to select an output order for image data stored in the memory to be the opposite of an input order of the data if the selection signal indicates the normal screen, and is to select the output order for image data stored in the memory to be the same as the input order of the image data stored in memory if the selection signal indicates the reversed screen.

7. The LCD device as claimed in claim 1, wherein the timing controller is to drive each of the sequence of data ICs and the sequence of gate ICs in a first order to generate the normal screen and in the same order to generate the reversed screen.

8. The LCD device as claimed in claim 1, wherein the timing controller is to supply a source start pulse to the first data IC of the plurality of data ICs and a gate start pulse to the first gate IC of the plurality of gate ICs to generate the normal screen and to generate the reversed screen.

9. A method for driving a liquid crystal display (LCD) device, comprising:

storing image data of one frame in a memory;

outputting the data stored in the memory in an order opposite to an order in which the data was previously input if a selection signal indicates a reversed screen;

sequentially latching the output data in a plurality of data ICs to drive a plurality of data lines; and sequentially driving a plurality of gate ICs to drive a plurality of gate lines.

10. The method as claimed in claim 9, further comprising:

supplying a source start pulse to the first data IC of the plurality of data ICs; and supplying a gate start pulse to the first gate IC of the plurality of gate ICs.

11. A method for driving a liquid crystal display (LCD) device, comprising:

storing image data of one frame in a memory;

selecting an output order of the data stored in the memory and outputting the data in the selected output order in accordance with a selection signal;

sequentially latching the output data from the memory in a plurality of data ICs to drive a plurality of data lines; and sequentially driving a plurality of gate ICs to drive a plurality of gate lines.

12. The method as claimed in claim 11, further comprising:

supplying a source start pulse to the first data IC of the plurality of data ICs; and supplying a gate start pulse to the first gate IC of the plurality of gate ICs.

13. The method as claimed in claim 11, wherein selecting an output order of the data stored in the memory includes selecting an output order to be in the same order as an input order of the stored data if the selection signal indicates a normal screen, and selecting an output order to be in the opposite order as the input order of the stored data if the selection signal indicates a reversed screen.

14. The method as claimed in claim 11, wherein selecting an output order of the data stored in the memory includes selecting an output order to be in the opposite order as an input order of the stored data if the selection signal indicates a normal screen, and selecting an output order to be in the same order as the input order of the stored data if the selection signal indicates a reversed screen.

15. The method as claimed in claim 11, wherein the plurality of data ICs are sequentially latched in a first latching order and the plurality of gate ICs are driven in a first driving order to generate the normal screen and are the plurality of data ICs sequentially latched in the first latching order and the plurality of gate ICs are driven in the first driving order to generate a reversed screen.

16. The method as claimed in claim 11 including:

supplying a source start pulse to the first data IC of the plurality of data ICs; and supplying a gate start pulse to the first gate IC of the plurality of gate ICs, wherein selecting an output order of the data stored in the memory and outputting the data in the selected output order in accordance with a selection signal includes setting the selection signal to indicate a reversed screen and selecting the output order to be in the opposite order as an input order of the stored data.

* * * * *